US011384475B2

(12) United States Patent
Kwon et al.

(10) Patent No.: US 11,384,475 B2
(45) Date of Patent: Jul. 12, 2022

(54) LAUNDRY TREATING APPARATUS

(71) Applicant: LG ELECTRONICS INC., Seoul (KR)

(72) Inventors: Yongwoo Kwon, Seoul (KR); Yeongkyeong Choi, Seoul (KR); Gyuri Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 265 days.

(21) Appl. No.: 16/776,739

(22) Filed: Jan. 30, 2020

(65) Prior Publication Data

US 2020/0248393 A1 Aug. 6, 2020

(30) Foreign Application Priority Data

Feb. 1, 2019 (KR) ..... 10-2019-0014095
May 22, 2019 (KR) ..... 10-2019-0060211

(51) Int. Cl.
*D06F 39/14* (2006.01)
*D06F 39/08* (2006.01)

(52) U.S. Cl.
CPC ..... *D06F 39/14* (2013.01); *D06F 39/08* (2013.01)

(58) Field of Classification Search
CPC ..... D06F 39/14; D06F 39/08; D06F 39/12; D06F 37/28; D06F 37/10; D06F 37/18
USPC ..... 68/196
See application file for complete search history.

(56) References Cited

U.S. PATENT DOCUMENTS

| | | | |
|---|---|---|---|
| 6,256,823 | B1 | 7/2001 | Kronbetter et al. |
| 8,148,633 | B2 | 4/2012 | Hung |
| 8,555,681 | B2 | 10/2013 | Caudevilla De Sola et al. |
| 8,570,737 | B2 | 10/2013 | Rayner |
| 2004/0177656 | A1 | 9/2004 | Kwon |

(Continued)

FOREIGN PATENT DOCUMENTS

| | | |
|---|---|---|
| CN | 1475621 | 2/2004 |
| CN | 1607290 | 4/2005 |

(Continued)

OTHER PUBLICATIONS

Russian Office Action issued in Application No. 2020200539 dated Jun. 11, 2020.

(Continued)

*Primary Examiner* — David G Cormier
*Assistant Examiner* — Thomas Bucci
(74) *Attorney, Agent, or Firm* — KED & Associates LLP

(57) ABSTRACT

A laundry treating apparatus may include a main body having a laundry inlet port on a front surface thereof, and a door that opens and closes the laundry inlet port. The door may include an outer frame facing an outside of the main body; a front glass attached to a front surface of the outer frame to define a front surface of the door; a door window spaced apart from the front glass toward the laundry inlet port and disposed to correspond to the laundry inlet port; an inner frame connected to the outer frame and the door window, and defining a portion of a rear surface of the door; and a flow path provided between the front glass and the outer frame and configured to provide communication between an inside and an outside of the door. Moisture or water introduced into the door may be discharged to the outside of the door through the flow path.

30 Claims, 14 Drawing Sheets

(56) References Cited

U.S. PATENT DOCUMENTS

| | | | | |
|---|---|---|---|---|
| 2005/0034486 | A1 | 2/2005 | Bienick et al. | |
| 2005/0138974 | A1 | 6/2005 | Ha et al. | |
| 2005/0262681 | A1 | 12/2005 | Yoon | |
| 2006/0117813 | A1 | 6/2006 | Ha et al. | |
| 2006/0218975 | A1 | 10/2006 | Graute et al. | |
| 2007/0051012 | A1 | 3/2007 | Schoene | |
| 2007/0125132 | A1 | 6/2007 | Hwang | |
| 2007/0137261 | A1 | 6/2007 | Kwon | |
| 2007/0240456 | A1* | 10/2007 | Byun | D06F 39/02 68/17 R |
| 2008/0223085 | A1 | 9/2008 | Park | |
| 2008/0302141 | A1* | 12/2008 | Chung | D06F 39/14 68/196 |
| 2009/0165391 | A1 | 7/2009 | Kocak et al. | |
| 2011/0025178 | A1* | 2/2011 | Schone | D06F 39/14 312/228 |
| 2011/0050059 | A1 | 3/2011 | Kim et al. | |
| 2015/0000200 | A1 | 1/2015 | Kim et al. | |
| 2015/0003027 | A1 | 1/2015 | Han et al. | |
| 2016/0369445 | A1* | 12/2016 | Kim | D06F 37/28 |
| 2017/0121884 | A1 | 5/2017 | Kwon et al. | |
| 2017/0121889 | A1 | 5/2017 | Kwon et al. | |
| 2017/0121890 | A1 | 5/2017 | Kwon et al. | |
| 2017/0167070 | A1 | 6/2017 | Khamprachom et al. | |
| 2017/0183803 | A1* | 6/2017 | Kim | E06B 5/00 |
| 2017/0260678 | A1 | 9/2017 | Wee et al. | |
| 2018/0002853 | A1 | 1/2018 | Anand et al. | |
| 2018/0163333 | A1* | 6/2018 | Zhang | D06F 37/10 |
| 2018/0195226 | A1* | 7/2018 | Kwon | G05B 19/409 |
| 2018/0216282 | A1 | 8/2018 | Lee et al. | |
| 2018/0274155 | A1 | 9/2018 | Anand et al. | |
| 2018/0363198 | A1* | 12/2018 | Gim | D06F 37/263 |
| 2019/0071815 | A1* | 3/2019 | Woodham, Jr. | D06F 39/14 |

FOREIGN PATENT DOCUMENTS

| | | | | |
|---|---|---|---|---|
| CN | 1880559 | | 12/2006 | |
| CN | 1940167 | | 4/2007 | |
| CN | 101074531 | | 11/2007 | |
| CN | 101671930 | | 3/2010 | |
| CN | 104372569 | | 2/2015 | |
| CN | 104420137 | | 3/2015 | |
| CN | 204311247 | | 5/2015 | |
| CN | 104975466 | | 10/2015 | |
| CN | 204780322 | | 11/2015 | |
| CN | 105937137 | | 9/2016 | |
| CN | 106012423 | | 10/2016 | |
| CN | 106032611 | | 10/2016 | |
| CN | 106133231 | | 11/2016 | |
| CN | 205907515 | | 1/2017 | |
| CN | 107287850 | | 10/2017 | |
| CN | 107541888 | | 1/2018 | |
| CN | 107641942 | | 1/2018 | |
| CN | 107974810 | | 5/2018 | |
| CN | 108796966 | | 11/2018 | |
| CN | 208293271 | | 12/2018 | |
| CN | 109112795 | | 1/2019 | |
| DE | 29721320 | | 2/1998 | |
| DE | 20 2012 101253 | | 4/2013 | |
| DE | 20 2014 010 568 | | 2/2016 | |
| EP | 0 870 861 | | 10/1998 | |
| EP | 1 262 589 | | 12/2002 | |
| EP | 1 522 623 | | 4/2005 | |
| EP | 1522623 | A1 * | 4/2005 | D06F 37/266 |
| EP | 1 309 749 | | 12/2005 | |
| EP | 1 860 228 | | 11/2007 | |
| EP | 2 147 996 | | 1/2010 | |
| EP | 2 161 364 | | 3/2010 | |
| EP | 2 677 076 | | 12/2013 | |
| EP | 3 112 524 | | 1/2017 | |
| EP | 2 740 833 | | 4/2017 | |
| EP | 3 162 945 | | 5/2017 | |
| EP | 3 181 750 | | 6/2017 | |
| EP | 3 332 060 | | 6/2018 | |
| EP | 3 363 945 | | 8/2018 | |
| EP | 3 875 670 | | 9/2021 | |
| FR | 2691298 | | 11/1993 | |
| FR | 2 733 258 | | 10/1996 | |
| FR | 2756575 | | 6/1998 | |
| GB | 2118580 | | 11/1983 | |
| GB | 2320507 | | 6/1998 | |
| IT | VR20120061 | | 9/2017 | |
| JP | H06-31766 | | 4/1994 | |
| JP | H10-24130 | | 1/1998 | |
| JP | 2000-145022 | | 5/2000 | |
| JP | 2005-058771 | | 3/2005 | |
| JP | 2005-160952 | | 6/2005 | |
| JP | 2008-295957 | | 12/2008 | |
| JP | 2010-063522 | | 3/2010 | |
| JP | 2012-075689 | | 4/2012 | |
| JP | 2012-223344 | | 11/2012 | |
| JP | 2014-003293 | | 1/2014 | |
| JP | 2014-151948 | | 8/2014 | |
| JP | 2016-049112 | | 4/2016 | |
| JP | 2017-038828 | | 2/2017 | |
| JP | 2017-099993 | | 6/2017 | |
| JP | 2018-514346 | | 6/2018 | |
| JP | 2018-110645 | | 7/2018 | |
| JP | 2018-531753 | | 11/2018 | |
| JP | 2018-532545 | | 11/2018 | |
| JP | 2018-536517 | | 12/2018 | |
| KR | 10-2004-0011219 | | 2/2004 | |
| KR | 10-0465148 | | 1/2005 | |
| KR | 2005-0021057 | | 3/2005 | |
| KR | 10-0595180 | | 6/2006 | |
| KR | 10-2007-0002458 | | 1/2007 | |
| KR | 10-2007-0044599 | | 4/2007 | |
| KR | 10-2007-0070780 | | 7/2007 | |
| KR | 10-2010-0019091 | | 2/2010 | |
| KR | 10-2010-0042984 | | 4/2010 | |
| KR | 10-2011-0013011 | | 2/2011 | |
| KR | 10-2011-0028899 | | 3/2011 | |
| KR | 10-1138697 | | 6/2012 | |
| KR | 10-1156707 | | 6/2012 | |
| KR | 10-2014-0006647 | | 1/2014 | |
| KR | 10-2015-0003592 | | 1/2015 | |
| KR | 10-2015-0006264 | | 1/2015 | |
| KR | 10-2016-0041886 | | 4/2016 | |
| KR | 10-1708350 | | 2/2017 | |
| KR | 10-1708351 | | 2/2017 | |
| KR | 10-1708352 | | 2/2017 | |
| KR | 10-1708355 | | 2/2017 | |
| KR | 10-2018-0089992 | | 8/2018 | |
| KR | 10-2018-0136086 | | 12/2018 | |
| KR | 10-2018-0136094 | | 12/2018 | |
| KR | 10-2018-0136095 | | 12/2018 | |
| KR | 10-2018-0136102 | | 12/2018 | |
| RU | 2355836 | | 5/2009 | |
| WO | WO 2015/144236 | | 10/2015 | |
| WO | WO 2017/020959 | | 2/2017 | |
| WO | WO 2018/001160 | | 1/2018 | |
| WO | WO 2018/077130 | | 5/2018 | |
| WO | WO-2018121942 | A1 * | 7/2018 | D06F 39/14 |
| WO | WO 2018/138946 | | 8/2018 | |

OTHER PUBLICATIONS

European Search Report issued in Application No. 20152173.9 dated Jul. 1, 2020.

Australian Office Action issued in Application No. 2020102680/03 dated Aug. 17, 2020.

Japanese Office Action dated Feb. 2, 2021 issued in JP Application No. 2020-012212.

European Search Report dated Jun. 29, 2020 issued in Application No. 20152175.4.

Japanese Office Action dated Mar. 2, 2021 issued in JP Application No. 2020-013080.

Australian Office Action dated Apr. 1, 2021 issued in AU Application No. 2020200550.

Australian Office Action dated Sep. 17, 2020 issued in AU Application No. 2020200522.

(56) References Cited

OTHER PUBLICATIONS

Korean Office Action dated Jun. 15, 2021 issued in KR Application No. 10-2019-0124785.
Russian Notice of Allowance dated May 25, 2020 issued in RU Application No. 2020102678.
European Search Report dated Jul. 1, 2020 issued in EP Application No. 20152172.1.
Australian Examination Report dated Aug. 17, 2020 issued in Application No. 2020200534.
International Search Report dated May 18, 2020 issued in PCT Application No. PCT/KR2020/001531.
Korean Office Action dated Jun. 15, 2021 issued in KR Application No. 10-2019-0127328.
Korean Office Action dated Jun. 15, 2021 issued in KR Application No. 10-2019-0127330.
Korean Office Action dated Jun. 15, 2021 issued in KR Application No. 10-2019-0127998.
Korean Office Action dated Jun. 15, 2021 issued in KR Application No. 10-2020-0011873.
Korean Office Action dated Jun. 15, 2021 issued in KR Application No. 10-2019-0058251.
Korean Office Action dated Jun. 15, 2021 issued in KR Application No. 10-2019-0060211.
Japanese Office Action dated Dec. 15, 2020 issued in JP Application No. JP 2020-013134.
Japanese Office Action dated Dec. 15, 2020 issued in JP Application No. JP 2020-013137.
Japanese Office Action dated Feb. 2, 2021 issued in JP Application No. JP 2020-013079.
U.S. Office Action dated Dec. 15, 2021 issued in U.S. Appl. No. 16/776,820.
Russian Notice of Allowance dated Apr. 21, 2020 issued in RU Application No. 2020103239.
Russian Notice of Allowance dated May 15, 2020 issued in RU Application No. 2020103240.
Russian Office Action dated Jun. 18, 2020 issued in RU Application No. 2020103247.
European Search Report dated Jun. 24, 2020 issued in EP Application No. 20152188.7.
European Search Report dated Jun. 24, 2020 issued in EP Application No. 20152181.2.
European Search Report dated Jun. 24, 2020 issued in EP Application No. 20152156.4.
European Search Report dated Jul. 1, 2020 issued in EP Application No. 20152169.7.
European Search Report dated Jul. 7, 2020 issued in EP Application No. 20152158.0.
Korean Office Action dated Jul. 23, 2020 issued in KR Application No. 10-2019-0058241.
Russian Notice of Allowance dated Aug. 25, 2020 issued in RU Application No. 2020103247.
Australian Office Action dated Sep. 2, 2020 issued in AU Application No. 2020200550.
Chinese Office Action dated Mar. 3, 2022 issued in CN Application No. 201911291955.6.
Chinese Office Action dated Mar. 4, 2022 issued in CN Application No. 201911338352.7.
Chinese Office Action dated Mar. 8, 2022 issued in CN Application No. 201911356949.4.
Chinese Office Action dated Mar. 17, 2022 issued in CN Application No. 201911338904.4.
Chinese Office Action dated Mar. 21, 2022 issued in CN Application No. 201911265766.1.
Chinese Office Action dated Apr. 2, 2022 issued in CN Application No. 201911356952.6.
German Office Action dated Apr. 8, 2022 issued in DE Application No. 102020100945.3.
United States Office Action dated Mar. 2, 2022 issued in co-pending related U.S. Appl. No. 16/776,779.
United States Office Action dated Jan. 14, 2022 issued in co-pending related U.S. Appl. No. 16/776,695.
U.S. Appl. No. 16/776,624, filed Jan. 30, 2020.
U.S. Appl. No. 16/776,639, filed Jan. 30, 2020.
U.S. Appl. No. 16/776,683, filed Jan. 30, 2020.
U.S. Appl. No. 16/776,695, filed Jan. 30, 2020.
U.S. Appl. No. 16/776,739, filed Jan. 30, 2020.
U.S. Appl. No. 16/776,780, filed Jan. 30, 2020.
U.S. Appl. No. 16/776,779, filed Jan. 30, 2020.
U.S. Appl. No. 16/776,820, filed Jan. 30, 2020.
U.S. Office Action issued in U.S. Appl. No. 16/776,780 dated May 24, 2022.
Chinese Office Action issued in Application No. 201911356954.5 dated May 7, 2022.

* cited by examiner

LAUNDRY TREATING APPARATUS

Pursuant to 35 U.S.C. § 119(a), this application claims the benefit of the earlier filing date and the right of priority to Korean Patent Applications No. 10-2019-0014095, filed in Korea on Feb. 1, 2019, and No. 10-2019-0060211, filed in Korea on May 22, 2019, the contents of which are incorporated by reference herein in their entirety.

BACKGROUND

1. Field

A laundry treating apparatus having a door that opens and closes a laundry inlet port of a main body are disclosed herein.

2. Background

Laundry treating apparatuses may include apparatuses for washing laundry or other items (hereinafter, collectively referred to as "laundry"), apparatuses for drying laundry, and apparatuses for washing and drying laundry. In the laundry treating apparatus, washing laundry is an operation for removing contaminants from the laundry using water and detergent, and drying laundry is an operation for removing moisture contained in the laundry using a hot air supply device provided in the laundry treating apparatus.

A door of a laundry dryer/drum washing machine is disclosed in Korean Registration Patent Application No. 10-0595180, registered on Jun. 23, 2006 and hereinafter, referred to as "Patent Document 1", which is hereby incorporated by reference. The laundry treating apparatus disclosed in Patent Document 1 is equipped with a main body provided with a laundry inlet port on a front surface, and a door configured to open and close the laundry inlet port. The door may include a door frame rotatably coupled to the main body by a hinge unit, an outer window attached to a front surface of the door frame to define a front appearance of the door, and an inner window disposed to correspond to an opening in the door frame.

The door frame includes an outer door frame disposed toward an outside of the main body and an inner door frame disposed toward an inside of the main body, and the outer door frame and the inner door frame are fastened to each other. As each of the outer window and the inner window is made of a transparent material, a washing state inside of the drum may be viewed through the door window even when the door is closed. However, the related art laundry treating apparatus has the following problems.

First, moisture or water penetrates into a gap between the outer door frame and the inner door frame and remains inside of the door.

Second, the outer window is disposed to cover a front surface of the door frame, and when water or moisture (liquid) that has penetrated into the door through the gap between the outer door frame and the inner door frame is introduced into the outer window side, the outer window may appear cloudy. As the door window occupies a substantial portion of the front surface of the laundry treating apparatus, the above-described problem may act as a factor that degrades a sense of quality of the laundry treating apparatus.

A laundry treating apparatus is disclosed in Korean Registration Patent Application No. 10-1708352, registered on Feb. 14, 2017 and hereinafter, referred to as "Patent Document 2", which is hereby incorporated by reference. Referring to the abstract and FIG. 3 of Patent Document 2, the door includes a door frame, a door cover, and a door window.

The door cover is attached to a front surface of the door frame, defining an appearance of the door. The door frame may include an outer frame disposed toward an outside of the main body, and an inner frame fastened to a rear surface of the outer frame. The door window is mounted between the outer frame and the inner frame so as to correspond to the laundry inlet port.

However, with the door of Patent Document 2, moisture or water may penetrate inside of the door through a gap between the inner frame and the door window. In this case, moisture or water which has penetrated inside of the door causes water droplets to form on the door cover, such as steam. For this reason, it is difficult to see the washing state inside of the main body through the door cover and the door window.

BRIEF DESCRIPTION OF THE DRAWINGS

Embodiments will be described in detail with reference to the following drawings in which like reference numerals refer to like elements, and wherein.

DETAILED DESCRIPTION

Figure 1:
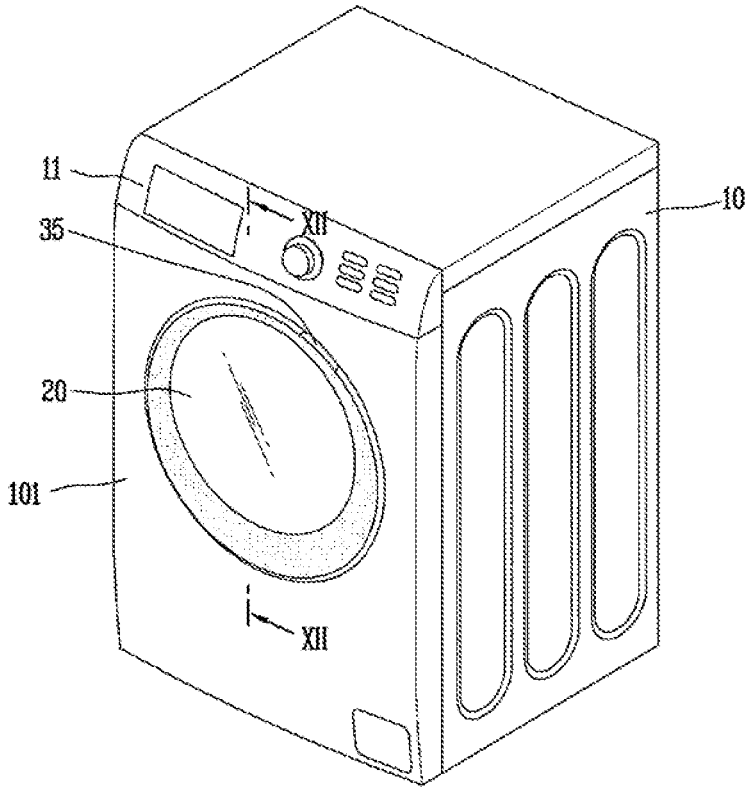
FIG. 1 is a perspective view of a laundry treating apparatus according to an embodiment.

Hereinafter, embodiments will be described with reference to the accompanying drawings. In the drawings, the same or similar elements are designated with the same or similar reference numerals, and redundant description has been omitted. The suffixes "module" and "unit" for components or elements used in the following description are given or mixed in consideration of ease in creating specification, and do not have distinct meanings or roles. In describing embodiments, if a detailed explanation for a related known technology or construction is considered to unnecessarily divert the gist, such explanation has been omitted but would be understood by those skilled in the art. Also, it should be understood that the accompanying drawings are merely illustrated to easily explain the concept, and therefore, they should not be construed to limit the technological concept disclosed herein by the accompanying drawings, and the concept should be construed as being extended to all modifications, equivalents, and substitutes included in the concept and technological scope.

Terms including ordinal numbers such as first and second may be used to describe various elements, but the elements are not limited by the terms. The terms are used merely for the purpose to distinguish an element from another element.

It will be understood that when an element is referred to as being "connected with" another element, the element can be directly connected with the other element or intervening elements may also be present. On the contrary, in case where an element is "directly connected" or "directly linked" to another element, it should be understood that any other element is not existed therebetween.

Singular expressions include plural expressions unless the context clearly indicates otherwise.

Terms "include" or "has" used herein should be understood that they are intended to indicate the existence of a feature, a number, a step, a constituent element, a component or a combination thereof disclosed in the specification, and it may also be understood that the existence or additional possibility of one or more other features, numbers, steps, elements, components or combinations thereof are not excluded in advance.

FIG. 1 is a perspective view of a laundry treating apparatus according to an embodiment. The laundry treating apparatus disclosed herein may include a main body 10, a laundry accommodating portion, and a door 12. The main body 10 may define an outer shape or appearance of the laundry treating apparatus. The main body 10 may be defined in a rectangular parallelepiped shape.

The main body 10 may include a front panel 101, a rear panel, side panels, an upper panel, and a lower panel. The front panel 101 may define a front surface of the laundry treating apparatus. The rear panel may define a rear surface of the laundry treating apparatus. The side panels may define left and right or lateral sides of the laundry treating apparatus, respectively. The upper panel may define an upper surface of the laundry treating apparatus. The lower panel may define a lower surface of the laundry treating apparatus.

A laundry inlet port 106 (see FIG. 12) may be defined in a circular shape through the front panel 101 so as to allow laundry to be put into the laundry accommodating portion through the laundry inlet port 106. A recess 103 (see FIG. 12) may be formed in the front panel 101. The recess 103 may be recessed in a circular shape. The recess 103 may surround the laundry inlet port 106. The recess 103 may accommodate a portion of a rear surface of the door 12. The laundry inlet port 106 may be formed eccentrically from a center of the recess 103.

A center of the laundry inlet port 106 may be formed inside of the recess 103 to extend directly upward from a center of the recess 103. An upper portion on the rear surface of the door 12 may be brought into contact with a circumference of the recess 103, and a lower portion on the rear surface of the door 12 may be spaced apart from the circumference of the recess 103 (see FIG. 12).

A contact portion 191 in contact with the circumference of the recess 103 may be provided on the upper portion on the rear surface of the door 12. A non-contact portion 192 spaced apart from the circumference of the recess 103 may be provided on the lower portion on the rear surface of the door 12. The contact portion 191 may protrude on the upper portion on the rear surface of the door 12 having a cross section in an arcuate shape.

The non-contact portion 192 may be inclined on the lower portion on the rear surface of the door 12. The circumference of the recess 103 may be rounded. Upper portions of the circumferences of the contact portion 191 and the recess 103 may be disposed to contact each other. According to this embodiment, the contact portion 191 may minimize vibration or shaking of the door 12 due to a collision between laundry and the door window 23 (see FIG. 12).

The laundry accommodating portion may be provided inside of the main body 10. The laundry accommodating portion may include (accommodate) a drum to perform a drying function, or a tub and a drum to perform washing and drying functions together.

In embodiments disclosed herein, in order to perform washing and drying functions together, a tub and a drum may be provided inside of the main body 10. The tub may be defined in a cylindrical shape. The tub may be disposed such that a central axis of the tub is horizontal or inclined at a predetermined angle in a lengthwise direction of the tub. The tub may be configured to store wash water inside thereof.

A gasket may be provided at a front end portion or end of the tub to communicate with the laundry inlet port 106. The gasket may prevent wash water stored inside of the tub from leaking into an accommodation space of the main body 10.

The drum may be provided in the tub to be rotatable with respect to the tub. A plurality of through holes may be formed through a circumferential surface of the drum. The plurality of through holes may allow a fluid, such as wash water, to be introduced into the drum or discharged from the drum to the tub.

A front portion of the drum may be open. The front portion of the drum may be in communication with the laundry inlet port 106. Laundry may be accommodated inside of the drum through the laundry inlet port 106.

A drive motor may be installed on a rear surface of the tub. The drive motor may be connected to the rear surface of the drum through a rotational shaft. As the drive motor is driven, power of the drive motor is transmitted to the drum through the rotational shaft, thereby rotating the drum.

The drum may be provided with a plurality of lifters therein. The drum may be configured to rotate laundry accommodated inside of the drum to a top of the drum by the plurality of lifters to perform washing and drying functions.

For example, the plurality of lifters may rotate along with the drum. The laundry spins from a bottom to a top of the drum along an inner circumferential surface of the drum. The laundry may fall to a bottom of the drum due to gravity. According to this, an effect of washing dirty laundry by beating the laundry with a paddle may be simulated.

A controller (control panel) 11 may be configured to display information related to operations of the laundry treating apparatus to a user and to receive the user's input. The controller 11 may include a display that displays visual information.

The controller 11 may include, for example, a circular knob and a plurality of buttons to receive the user's input. The controller 11 may be provided on the main body 10 or provided on the door 12. In embodiments disclosed herein, the controller 11 is located on an upper portion of the front panel 101 of the main body 10.

The door 12 may be rotatably installed on the front panel 101. The door 12 may be configured to open and close the laundry inlet port 106.

Figure 2:
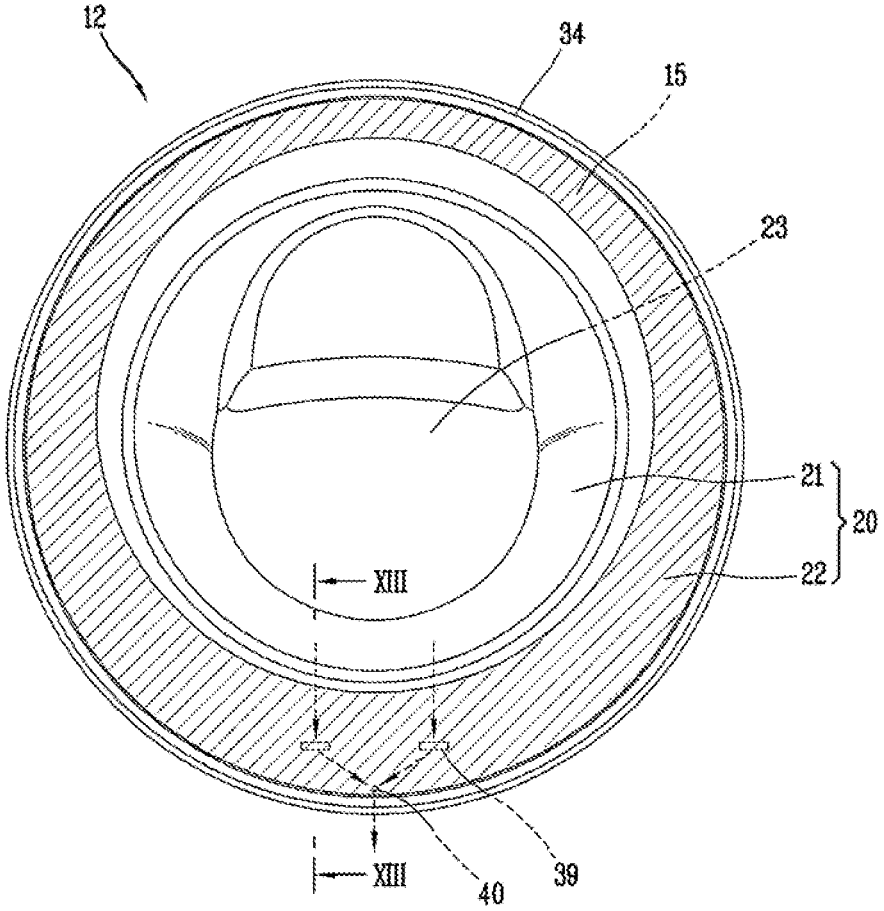
FIG. 2 is a front view of a door in FIG. 1.
Figure 3:
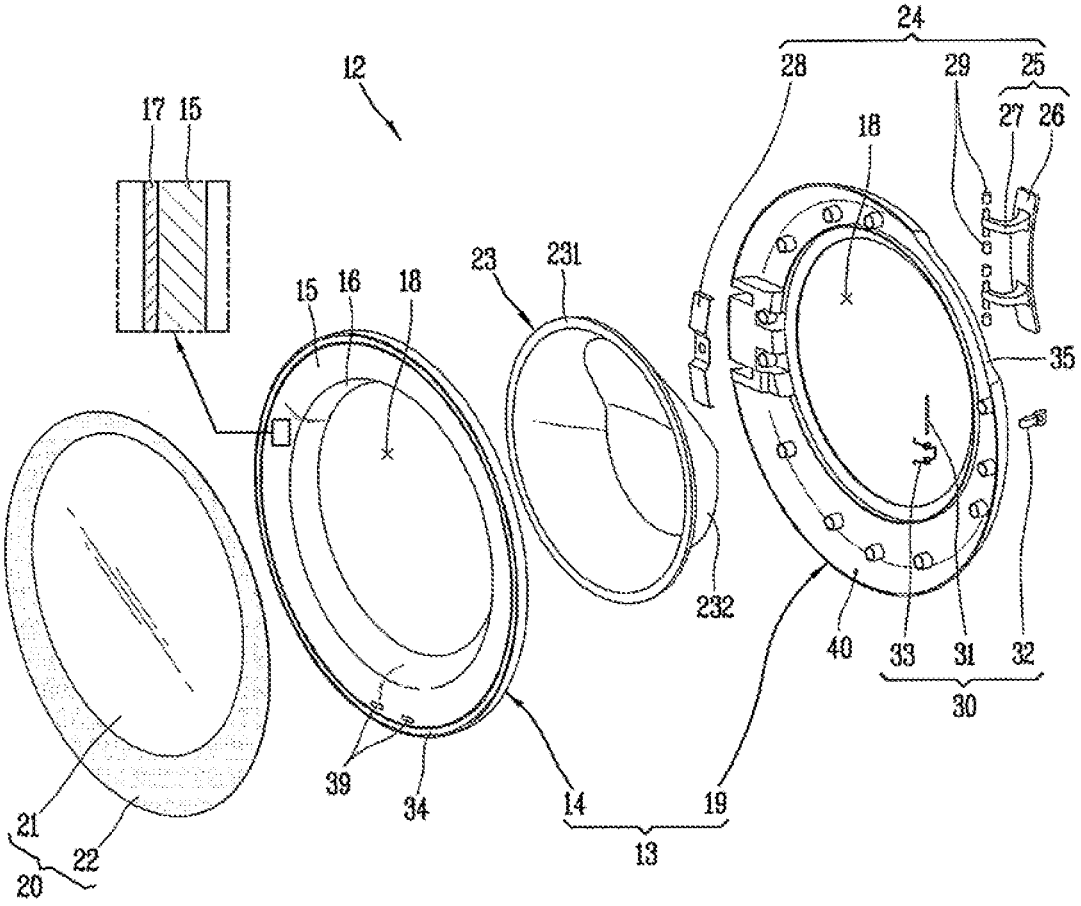
FIG. 3 is an exploded view of the door in FIG. 2.
Figure 4:
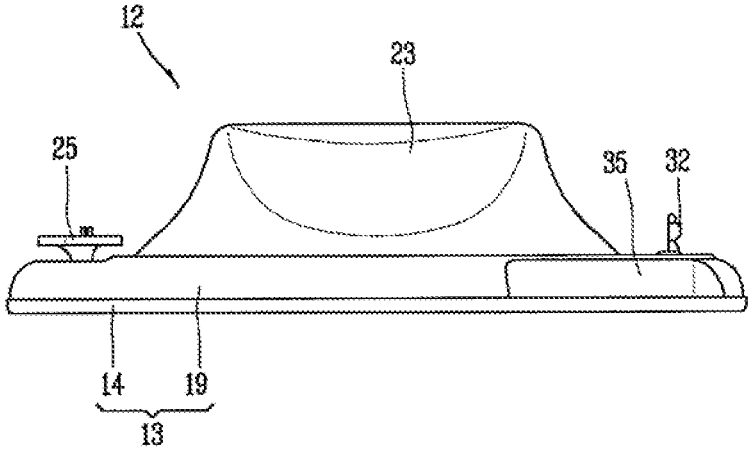
FIG. 4 is a planar view of the door in FIG. 2.
Figure 5:
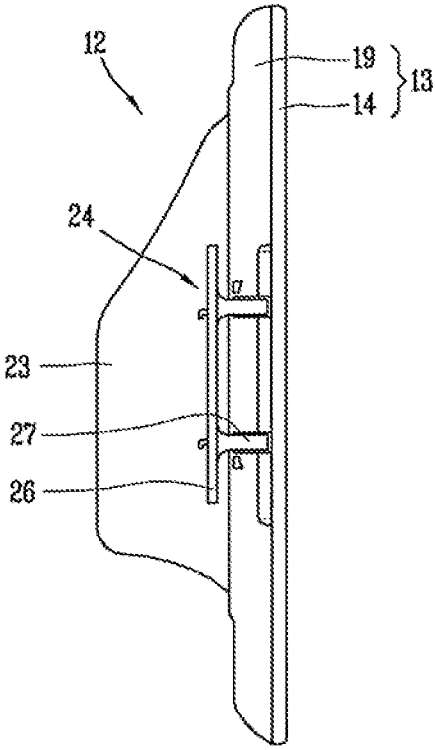
FIG. 5 is a left side view of the door in FIG. 2.
Figure 6:
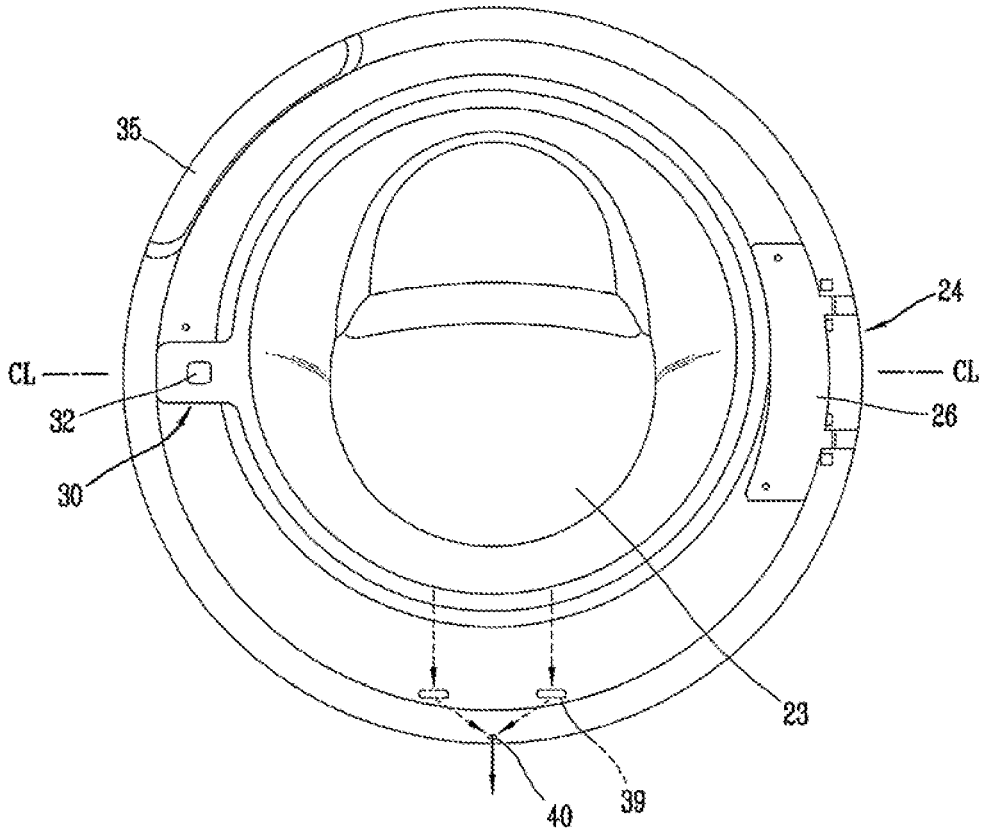
FIG. 6 is a rear view of a rear surface of the door in FIG. 2.
Figure 7:
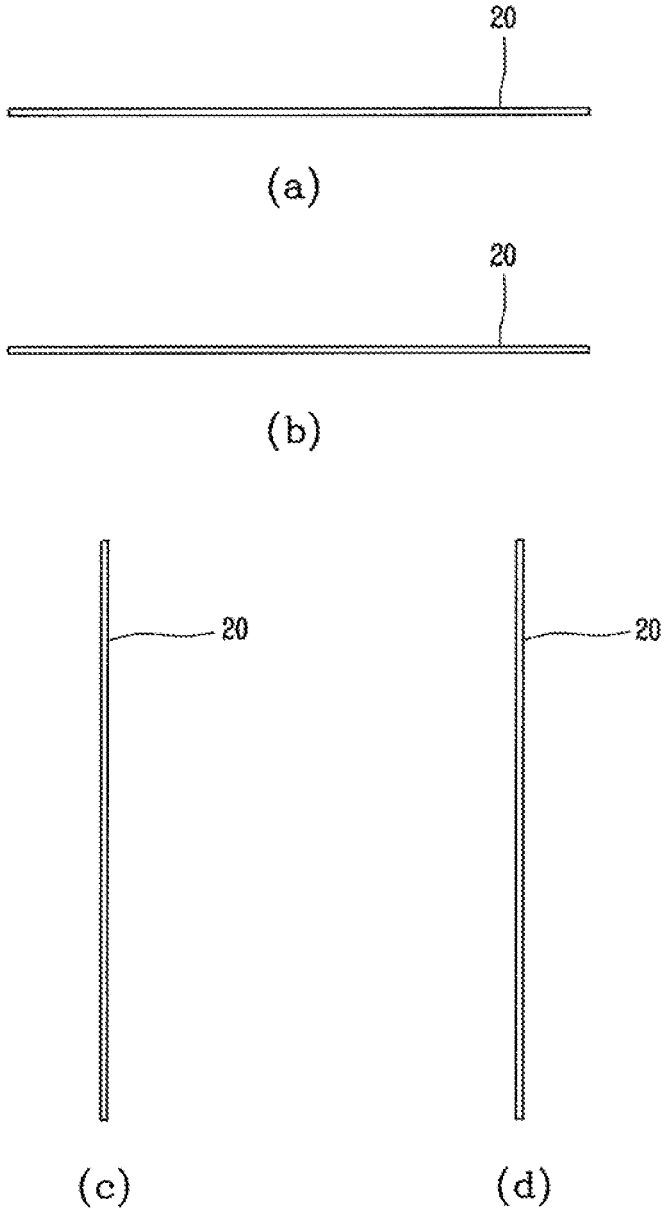
FIG. 7 is a view illustrating an upper side, a lower side, a left side, and a right side of the front glass in FIG. 3, respectively.

FIG. 2 is a front view of door 12 in FIG. 1. FIG. 3 is an exploded view of door 12 in FIG. 2. FIG. 4 is a planar view of door 12 in FIG. 2. FIG. 5 is a left side view of door 12 in FIG. 2. FIG. 6 is a rear view illustrating a rear surface of door 12 in FIG. 2. FIG. 7 is a view illustrating an upper side, a lower side, a left side, and a right side of front glass 20 in FIG. 3, respectively.

The door 12 may include a door frame 13, door window 23, front glass 20, a hinge unit or hinge 24, and a locking unit 30. The door frame 13 may be defined in a ring shape. An opening 18 may be located at an inner side of the door frame 13.

The door frame 13 may include an outer frame 14 and an inner frame 19. The outer frame 14 and the inner frame 19 may be formed of a synthetic resin material, for example, an acrylonitrile butadiene styrene (ABS) material, or a polycarbonate (PC) material. Each of the outer frame 14 and the inner frame 19 may be manufactured by injection molding, for example.

The outer frame 14 and the inner frame 19 may each have a ring shape. The inner frame 19 may be coupled at a rear surface side of the outer frame 14. A coupling between the outer frame 14 and the inner frame 19 may be made by pin-groove coupling, hook coupling, screw coupling, or bonding coupling, for example. In embodiments disclosed herein, each of the outer frame 14 and the inner frame 19 may be provided with a hook 36 at an outer circumference thereof to be engaged with each other by, for example, an interference or snap fit.

The outer frame 14 is disposed toward or faces an outside of the main body 10 and the inner frame 19 is disposed toward or faces an inside of the main body 10 in a state in which the door 12 is closed. The outer frame 14 may be referred to as a "first frame", and the inner frame 19 may be referred to as a "second frame".

The opening 18 may be circular and provided at inner side of the outer frame 14 and the inner frame 19, respectively, to face the laundry inlet port 106. The opening 18 may be eccentrically positioned from centers of the outer frame 14 and the inner frame 19, respectively. For example, a center of the opening 18 may be positioned above the centers of each of the outer frame 14 and the inner frame 19.

According to embodiments disclosed herein, each of the outer frame 14 and the inner frame 19 may vary in width along a circumferential direction. The term "width" may refer to a distance between an outer diameter and an inner diameter of the outer frame 14 or the inner frame 19. For example, a width of each of the outer frame 14 and the inner frame 19 may increase (widen) from a top end to a bottom end.

A center of the drum may be disposed higher than a center of a height (½) of the main body 10. The drum may be fixed in a heightwise direction of the main body 10 aside from minute vibration due to rotation.

Consumers tend to prefer a larger size of the door 12 with respect to a same capacity and size of washing machine when looking at the main body 10 from the front. In addition, consumers prefer to look into the drum through the door 12, and if possible, have a wide field of view with regard to an inner space of the drum.

In order to satisfy the needs of consumers, the door 12 must be enlarged downward to increase the size of the door 12 while a position of the drum is fixed. A center of the door frame 13 must move below the center of the laundry inlet port 106 or the opening 18. Similarly, the center of the door frame 13 may move downward with respect to the door window 23 positioned to correspond to the opening 18. In addition, in order to increase the size of the door 12, a portion of the door 12 that protrudes outward from the recess 103 and the door 12 may be provided with a larger diameter.

The front glass 20 may be attached to a front surface of the outer frame 14. The front glass 20 may cover the opening 18 of the door frame 13. The front glass 20 may be bonded to the front surface of the outer frame 14 by a sealant or an adhesive 38 (see FIG. 8), for example.

Due to a nature of the glass material, the front glass 20 is easily broken when a coupling hole is drilled into the front glass 20, and thus, the front glass 20 is attached to the outer frame 14 using an adhesive, for example, to prevent the glass from being broken. On the other hand, the front glass 20 made of the glass material occupies a relatively large load compared to a total load of the door 12. In order to support the load of the front glass 20, a mounting guide 34 to mount the front glass 20 may be provided on the front surface of the outer frame 14.

In particular, the front glass 20 may be made of tempered glass. Due to a nature of tempered glass, front and rear surfaces of the front glass 20 have a high strength; however, a circular outer circumferential surface, which is a side surface of the front glass 20, has a low strength.

To compensate for this, the mounting guide 34 may protrude forward from a front outer circumferential end of the outer frame 14 to surround an outer circumferential surface of the front glass 20. The mounting guide 34 may have a predetermined inner diameter and a ring shape. The mounting guide 34 may define a space in which the front glass 20 may be accommodated therein.

An inner diameter of the mounting guide 34 may correspond to an outer diameter of the front glass 20. The mounting guide 34 may surround the outer circumferential surface of the front glass 20.

The mounting guide 34 may support the load of the front glass 20 as well as protect the side surface of the front glass 20 from external impact. A protruding length of the mounting guide 34 may cover at least ⅔ of a thickness of the front glass 20. This is because an external impact may be applied to the outer circumferential surface of the front glass 20 and may break the front glass 20 when the protruding length of the mounting guide 34 is too short.

For example, a straight portion 202 (see FIG. 14) and a plurality of curved portions 201, 203 may be arranged on a side or circumferential surface, which is cut in a diameter (radial) direction at the outer circumferential surface of the front glass 20. The plurality of curved portions 201, 203 may include first curved portion 201 connected to a front surface of the front glass 20 and second curved portion 203 connected to a rear surface of the front glass 20. The straight portion 202 may extend between the first and second curved portions 201, 203 and be connected to the first and second curved portions 201, 203, respectively. Each of the first curved portion 201, the straight portion 202, and the second curved portion 203 may be ⅓ of the thickness of the front glass 20. The mounting guide 34 may cover the second curved portion 203 and the straight portion 202 of the front glass 20.

The front glass 20 may include a transparent region 21 and a non-transparent region 22. The transparent region 21 may be disposed at an inside of the front glass 20. The non-transparent region 22 may be disposed at an outside of the front glass 20.

The transparent region 21 denotes a region configured to transmit at least portion of light so that an opposite side or the inside may be viewed. Therefore, the transparent region 21 is a translucent region.

In a state in which the front glass 20 is attached to the door frame 13, the transparent region 21 may be disposed to correspond to the opening 18 of the door frame 13 and the door window 23. Therefore, while the door 12 is closed, the user may look into the laundry accommodating portion through the transparent region 21.

A center of the transparent region 21 may be located at a position corresponding to the center of the opening 18 of each of the outer frame 14 and the inner frame 19. The corresponding position may include not only perfect alignment with the center, but also alignment in an eccentric direction of the center.

That is, in embodiments disclosed herein, the center of the opening 18 may be eccentrically located from the center of the door frame 13 to an upper side (12 o'clock direction). Correspondingly, the center of the transparent region 21 may also be eccentrically located from the center of the front glass 20 to the upper side (12 o'clock direction). The center of the transparent region 21 and the center of the opening 18 may alternatively coincide with each other.

The non-transparent region 22 may surround the transparent region 21. The non-transparent region 22 does not transmit light. The non-transparent region 22 may cover a remaining portion except for the opening 18 and a portion of the door frame 13.

A boundary line between the transparent region 21 and the non-transparent region 22 surrounding the transparent region 21 may be clearly distinguished by the non-transparent region 22. Alternatively, the boundary between the transparent region 21 and the non-transparent region 22 may be blurred by a halftone technique, thereby providing a visual transition from the transparent region 21 to the non-transparent region 22.

The non-transparent region 22 may include a plurality of shielding dots arranged around the transparent region 21. The plurality of shielding dots may be arranged to have a lower density toward the transparent region 21.

Referring to FIG. 7, the front glass 20 may have a circular shape with a predetermined radius. The front glass 20 may be made of a glass material. The front glass 20 may be flat on front and rear surfaces thereof.

The front glass 20 may have a disc shape with a constant thickness, without bending even when viewed from any direction, that is, up, down, left, or right.

According to embodiments disclosed herein, the front glass 20 in a shape of a circular plate may enhance a quality grade of the door 12, compared to a door cover in the related art made of a synthetic resin material having a convex front surface in an incomplete circular shape.

The front glass 20 may include the transparent region 21, the non-transparent region 22, and an alignment mark (not illustrated) in a layered structure. The alignment mark may be a portion displayed on one side of the non-transparent region 22 to align the front glass 20 to the front surface of the outer frame 14. For example, the front glass 20 may include a glass body and a shielding layer. The glass body may be formed of a glass material having transparency. The shielding layer may cover a rear surface of the glass body. The shielding layer may form the non-transparent region 22.

In this case, a portion where the shielding layer is not disposed may define the transparent region 21 and an alignment mark. The shielding layer may be formed on the rear surface of the glass body in a glass printing manner, for example.

As another example, the front glass 20 may include a glass body and a film. The glass body may be formed of a glass material having transparency. The film may cover the rear surface of the glass body. The film may include a transparent portion having transparency corresponding to the transparent region 21, a non-transparent portion having non-transparency corresponding to the non-transparent region 22, and an alignment portion having transparency corresponding to the alignment mark.

As another example, the front glass 20 may include a glass body and a film. The glass body may be formed of a glass material having transparency. The film may cover the rear surface of the glass body. A difference from the above example is that the film may include a first hole corresponding to the transparent region 21, a non-transparent portion having non-transparency corresponding to the non-transparent region 22, and a second hole corresponding to the alignment mark. That is, there is a difference in whether the film has portions corresponding to the transparent region 21 and the alignment mark or through holes.

The outer frame 14 may include a flat portion 15, and a curved portion 16. The flat portion 15 may be in contact with the rear surface of the front glass 20, and a portion of the flat portion 15 may overlap with the non-transparent region 22. Adhesive 38 (see FIG. 8) may be applied to the flat portion 15 so that the front glass 20 may be adhered to the flat portion 15.

The curved portion 16 may be curved in an arc shape having a predetermined curvature toward an outer circumference of the opening 18 formed in the inner frame 19 from an inner end of the flat portion 15. An inner portion of the flat portion 15 and the curved portion 16 may overlap an outer edge portion of the transparent region 21. The opening 18 may be located at an inside of the curved portion 16 in a radial direction.

A protection layer 17 may be disposed on front and outer circumferential surfaces of the outer frame 14 by chromium plating, for example. The outer frame 14 may be completely immersed in a chromium plating solution, followed by the chromium plating, so that the protection layer 17 may be formed on an entire surface of the outer frame 14. Also, the outer frame 19 may be completely immersed in a chromium plating solution, followed by the chromium plating, so that the protection layer 17 may be formed on an entire surface of the inner frame 19.

The protection layer 17 may coat the outer frame 14 with a silver polished metal color. According to this, the protection layer 17 may obtain an effect in that it looks like circular droplets of bright silver. In addition, the protection layer 17 may produce a sense of high quality, for example, when viewed with the naked eye.

The door window 23 may correspond to the laundry input port 106 when the door 12 is closed. The door window 23 may be mounted to the door frame 13 to correspond to the opening 18 of the inner frame 19.

The door window 23 may be made of a transparent material, for example, a synthetic resin material having transparency. An inner space of the laundry accommodating portion, such as the drum, may be viewed through the door window 23. The door window 23 may not be necessarily limited to such synthetic material, but may alternatively be made of a glass material.

An outer edge portion or edge 231 of the door window 23 may be inserted and coupled between the outer frame 14 and the inner frame 19. The outer edge portion 231 of the door window 23 may have a flat shape, and may be fixedly disposed between a rear end of the curved portion 16 of the outer frame 14 and an inner end of the inner frame 19.

Referring to FIGS. 3 to 6, the door 12 may be rotatably provided in a frontward-rearward direction with respect to the main body 10 by the hinge unit 24. The hinge unit 24 may be mounted at one or a first side of the door 12. When the user looks at the closed door 12 from the front of the main body 10, the hinge unit 24 may be coupled to a left side.

The hinge unit 24 may include a hinge 25, a hinge holder 28, and a bush 29. The hinge 25 may be fixed to the main body 10 and may be rotatably coupled to the door frame 13. The hinge 25 may have a base portion 26 and a rotational coupling portion 27. The base portion 26 may have a plate shape coupled to the main body 10.

The rotational coupling portion 27 may protrude from the base portion 26 to be rotatably coupled to the door frame 13. A plurality of rotational coupling portions 27 may be provided spaced apart from each other in a vertical direction.

The hinge holder 28 may be coupled to the door frame 13 to support the rotational coupling portion 27. The hinge holder 28 may prevent the rotational coupling portion 27 from being released from the door frame 13.

The bush 29 may have a cylindrical shape to surround a rotational shaft of the rotational coupling portion 27. The bush 29 may be inserted into a rotational shaft of each rotational coupling portion 27 to smoothly rotate the rotational shaft.

The locking unit 30 may be provided at another or a second side of the door 12. When the user looks at the door 12 from the front of the main body, the locking unit 30 may be, for example, coupled to a right side on the rear surface of the door 12. The locking unit 30 may be configured to lock or unlock the door 12 to or from the main body 10.

The locking unit 30 may include a shaft 31, a door latch 32, and a spring 33. The shaft 31 may be inserted through the door latch 32 to be mounted to the door frame 13. The spring 33 has an elastic force to restore the door latch 32 when the door latch 32 is rotated.

According to embodiments disclosed herein, the door latch 32 may be rotatable and restorable with respect to the door frame 13. The door latch 32 may lock or unlock the door 12 with respect to the main body 10.

Referring to FIG. 4, handle 35 may be configured in a manner of recessing a rear upper side of the inner frame 19. The user may open the door 12 by pulling the handle 35.

The rear surface of the inner frame 19 may be convex rearward in an arcuate shape. The handle 35 may be provided on the door 12 for the user to open and close the door 12. In the related art, the handle is generally provided on a front side of the door. However, in embodiments disclosed herein, as the front glass 20 covers the front surface of the door 12, it is difficult to provide the handle 35 on the front glass 20.

Thus, the handle 35 is not provided on the front surface of the door 12 due to the front glass 20, but rather, is provided on a rear surface of the door 12. The handle 35 may be provided on the inner frame 19.

In addition, the handle 35 may be installed at a top portion of the door 12 so that the user may easily pull the door 12. When the handle 35 is provided at a lower portion of the door 12, the user has to bend his or her waist and knees more to pull the handle 35.

As the hinge unit 24 and the locking unit 30 are respectively provided at left and right or lateral sides of the door frame 13, respectively, along a horizontal center line CL-CL that horizontally passes through a center of the door frame 13 in the radial direction, they may be positioned higher than the horizontal center line. In addition, the handle 35 may be disposed on the upper side of the door frame 13 to be higher than the locking unit 30 in order to open and close the door 12 with less force. The handle 35 may be disposed on the upper side of the rear surface of the inner frame 19. More specifically, when the door 12 is closed, the handle 35 may be located at a right upper portion, namely, between one o'clock and three o'clock, when viewed from the front of the main body 10.

The handle 35 may recessed into the convex rear surface of the inner frame 19 toward the outer frame 14. The handle 35 may be formed in an arcuate shape on the rear surface of the inner frame 19 along a partial section of the rear surface in the circumferential direction.

The handle 35 may be thin and flat compared to an outer circumference of the inner frame 19 (a portion of the inner frame except for the handle 35). According to this configuration, insertion of the user's hand into the handle 35 as well as identification of a position of the handle 35 in the closed state of the door 12 are facilitated.

Figure 8:
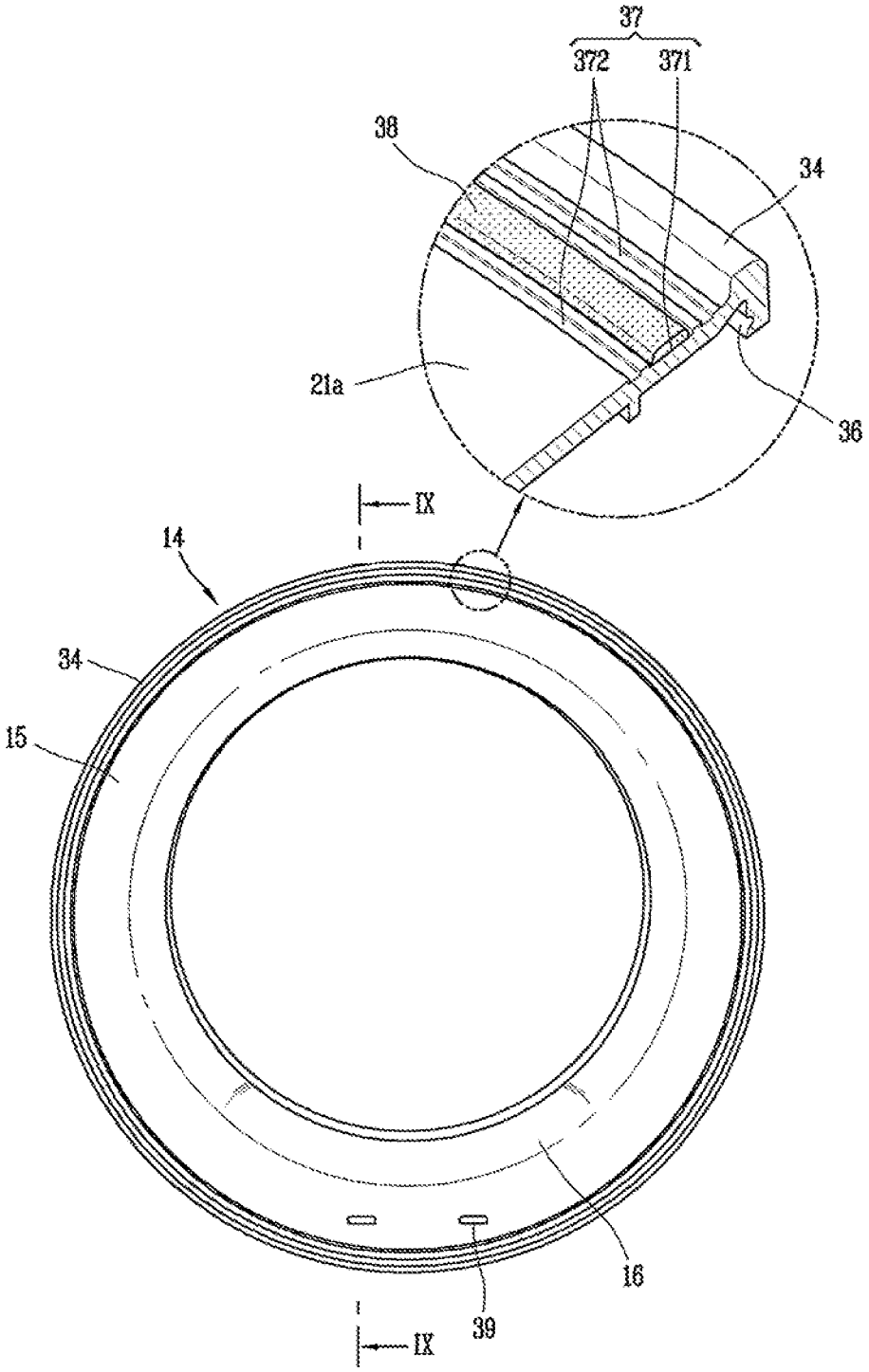
FIG. 8 is a front view of a front surface of the outer frame in FIG. 3.

FIG. 8 is a front view of a front surface of the outer frame 14 in FIG. 3. Referring to FIG. 8, the adhesive 38 may be disposed between the door frame 13 and the front glass 20. An adhesive groove 37 to which the adhesive 38 may be applied may be formed in the door frame 13. In FIG. 8, a state in which the adhesive groove 37 is formed on the front surface of the outer frame 14 is illustrated.

The adhesive groove 37 may be defined in a ring shape having a predetermined radius along the circumference of the mounting guide 34. The adhesive groove 37 may surround the opening 18. A gap between the mounting guide 34 and the adhesive groove 37 may be constant along the circumference of the mounting guide 34. That is, a center of the adhesive groove 37 may correspond to a center of the mounting guide 34.

As illustrated, the adhesive groove 37 may include an adhesive groove 371 and adhesive overflow groove 372. The adhesive groove 371 is a groove for receiving the adhesive 38 and may have a ring shape surrounding the opening 18. A gap between the mounting guide 34 and the adhesive groove 371 may be constant along the circumference of the mounting guide 34.

In this case, a center of the adhesive groove 371 may correspond to the center of the mounting guide 34. In addition, as the mounting guide 34 surrounds the outer circumference of the front glass 20 defined in a circular shape, the center of the adhesive groove 371 may correspond to the center of the front glass 20.

The adhesive overflow groove 372 may be disposed at an inner side and an outer side of the adhesive groove 371, respectively, with the adhesive groove 371 interposed therebetween. The adhesive overflow groove 372 may collect the adhesive 38 flowing to the inner side and the outer side of the adhesive groove 371, respectively.

The adhesive overflow groove 372 may extend side by side along the adhesive groove 371 spaced apart from the adhesive groove 371 at a predetermined gap. Each of the adhesive groove 371 and the adhesive overflow groove 372 may have a same center and different diameters.

As the adhesive groove 371 is a portion to which the adhesive 38 is applied, and the adhesive overflow groove 372 is a portion provided in preparation for overflow of the adhesive 38, the adhesive overflow groove 372 may have a narrower width than a width of the adhesive groove 371.

According to the above structure, even when the adhesive 38 filled in the adhesive groove 371 leaks out while the front glass 20 is coupled to the outer frame 14, the adhesive overflow groove 372 may collect the leaked adhesive 38. For this reason, deterioration of a quality of external appearance by leakage of the adhesive 38 may be prevented.

In addition, according to the above structure, the adhesive groove 371 may be disposed as close as possible to an edge portion or edge of the outer frame 14. Therefore, as a corresponding unbonded portion of the edge portion of the front glass 20 may be minimized, a bonding strength may be improved.

Hereinafter, a structure in which, even if moisture or water having penetrated inside of the door 12 is introduced onto the front glass 20 side, the introduced moisture or water may be removed, will be described.

Figure 9:
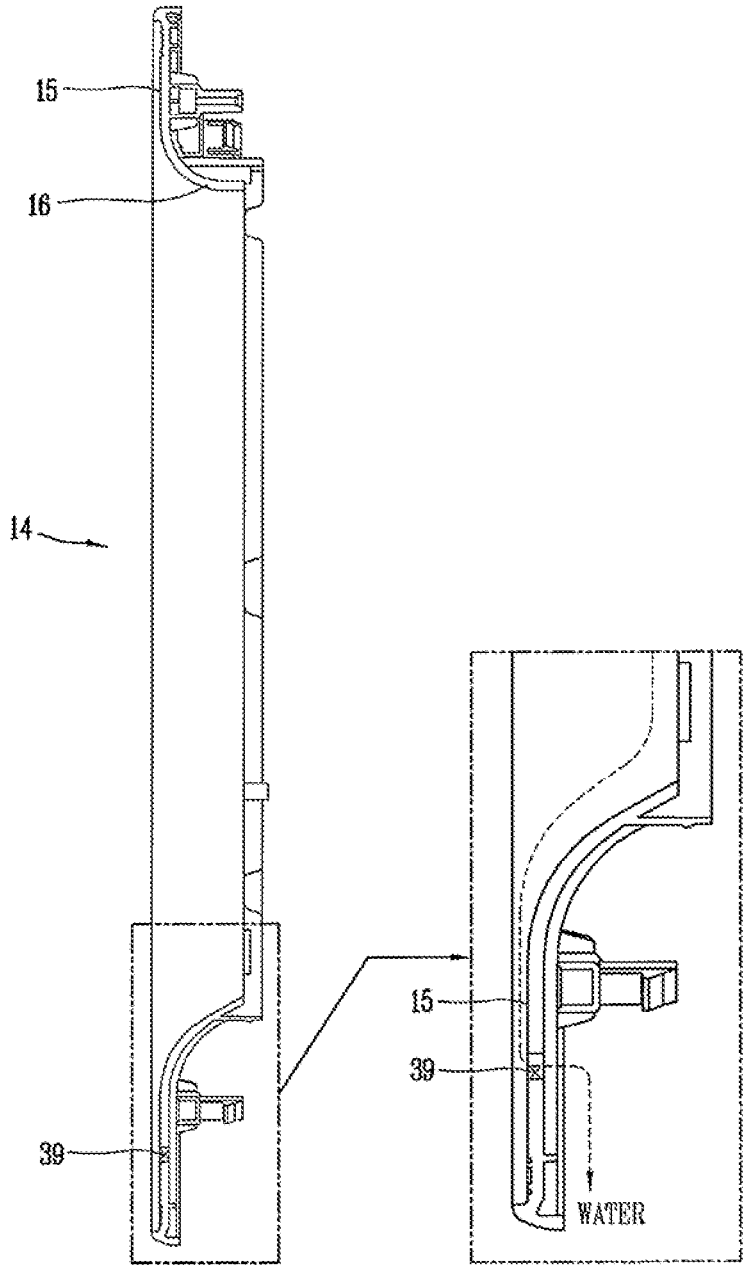
FIG. 9 is a cross-sectional view, taken along line IX-IX in FIG. 8, illustrating a state in which moisture or water introduced into the front glass flows into the outer frame through the communication hole.
Figure 10:
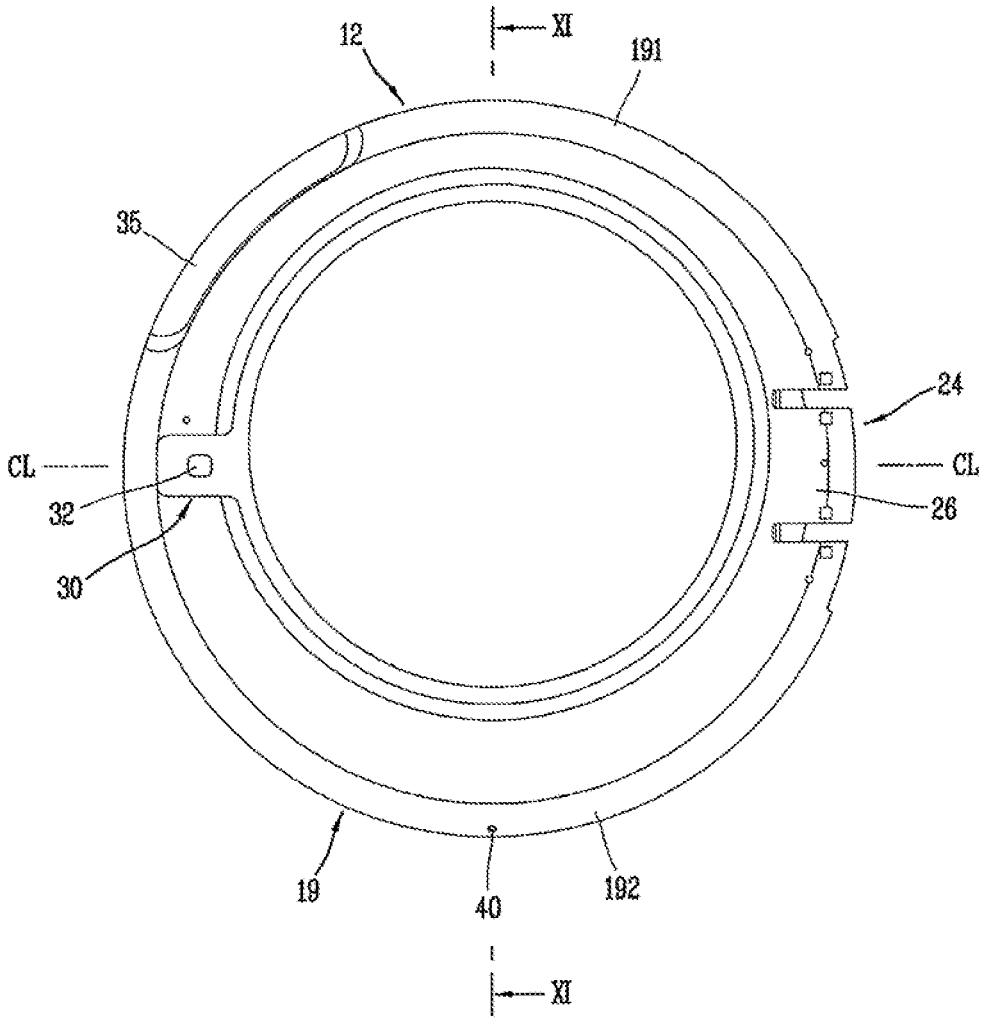
FIG. 10 is a rear view of a rear surface of the inner frame in FIG. 3.
Figure 11:
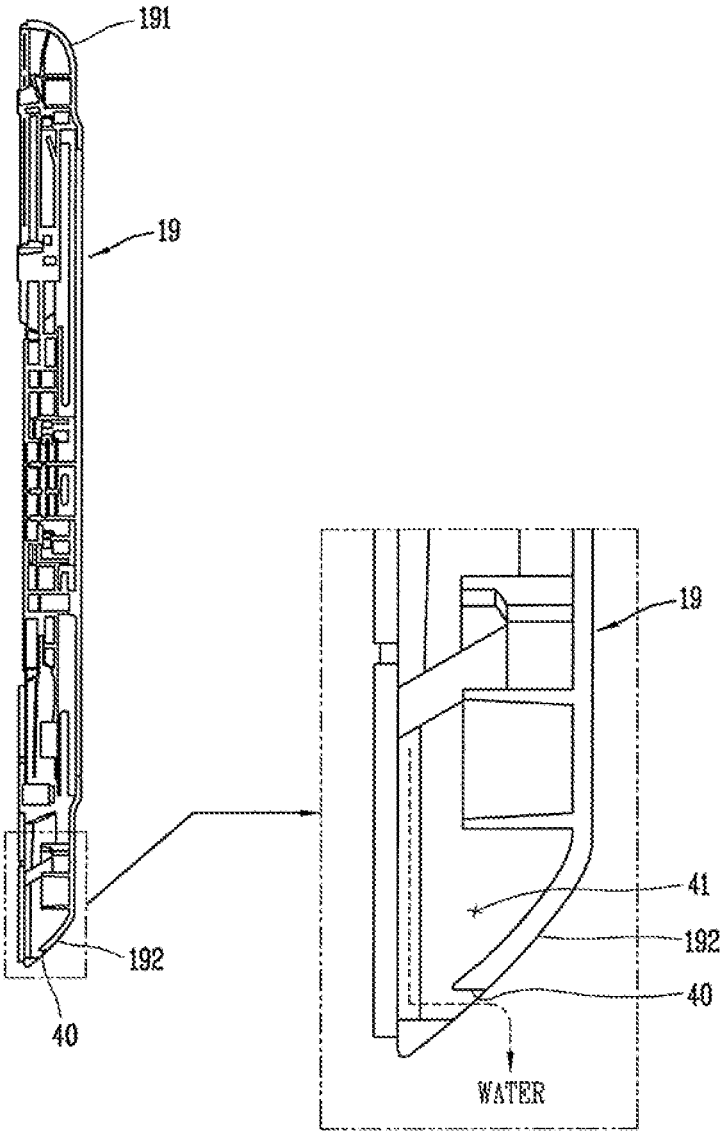
FIG. 11 is a cross-sectional view, taken along line XI-XI in FIG. 10, illustrating a state in which moisture or water is discharged through the discharge hole.
Figure 12:
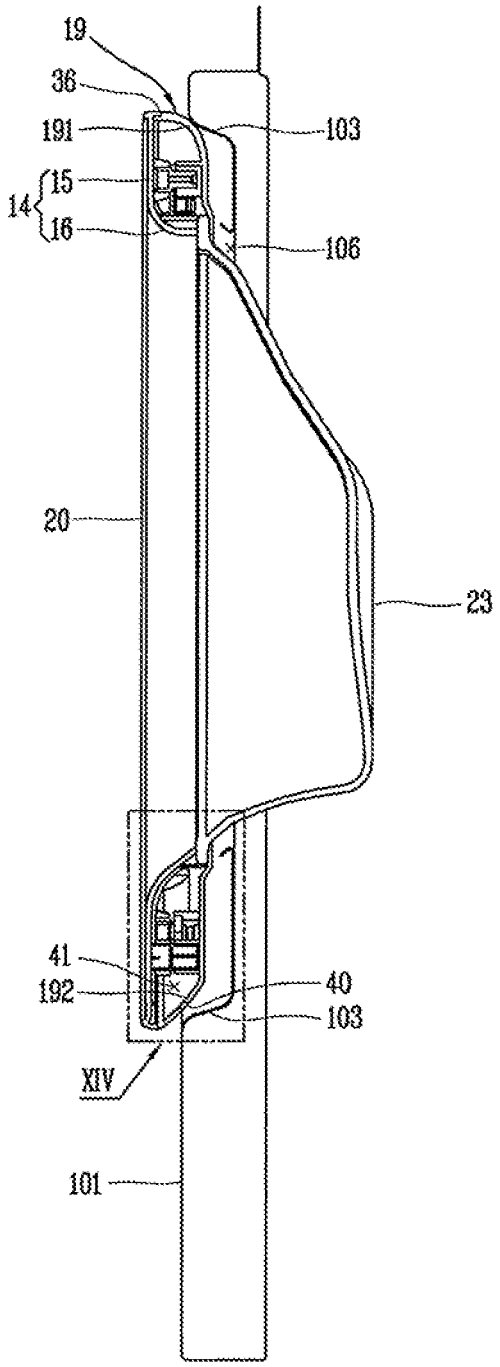
FIG. 12 is a cross-sectional view, taken along line XII-XII in FIG. 1, illustrating a state in which the door is mounted to the front panel.
Figure 13:
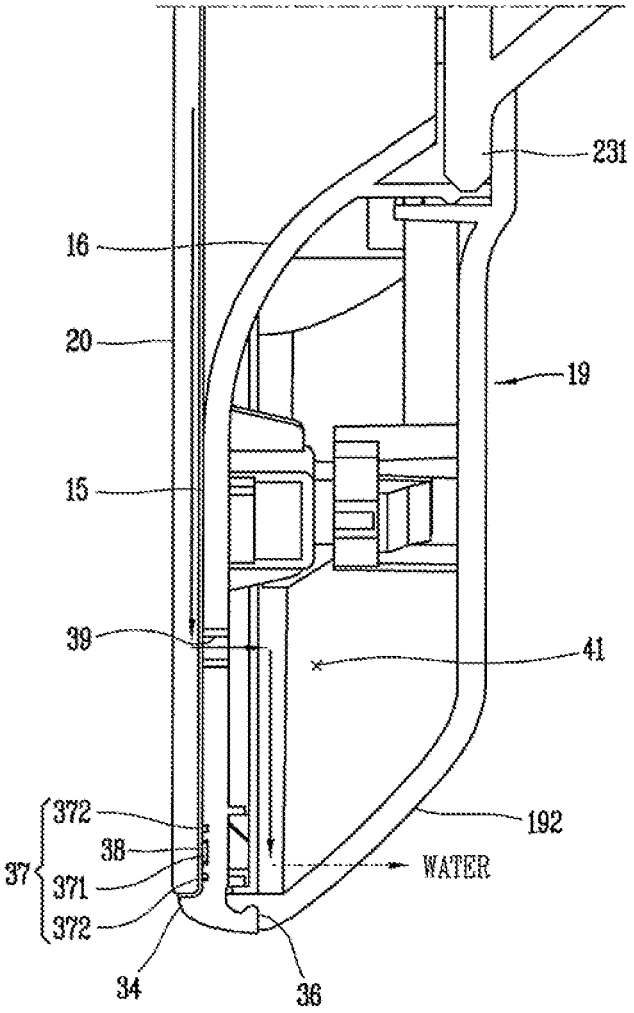
FIG. 13 is a cross-sectional view, taken along line XIII-XIII in FIG. 2.
Figure 14:
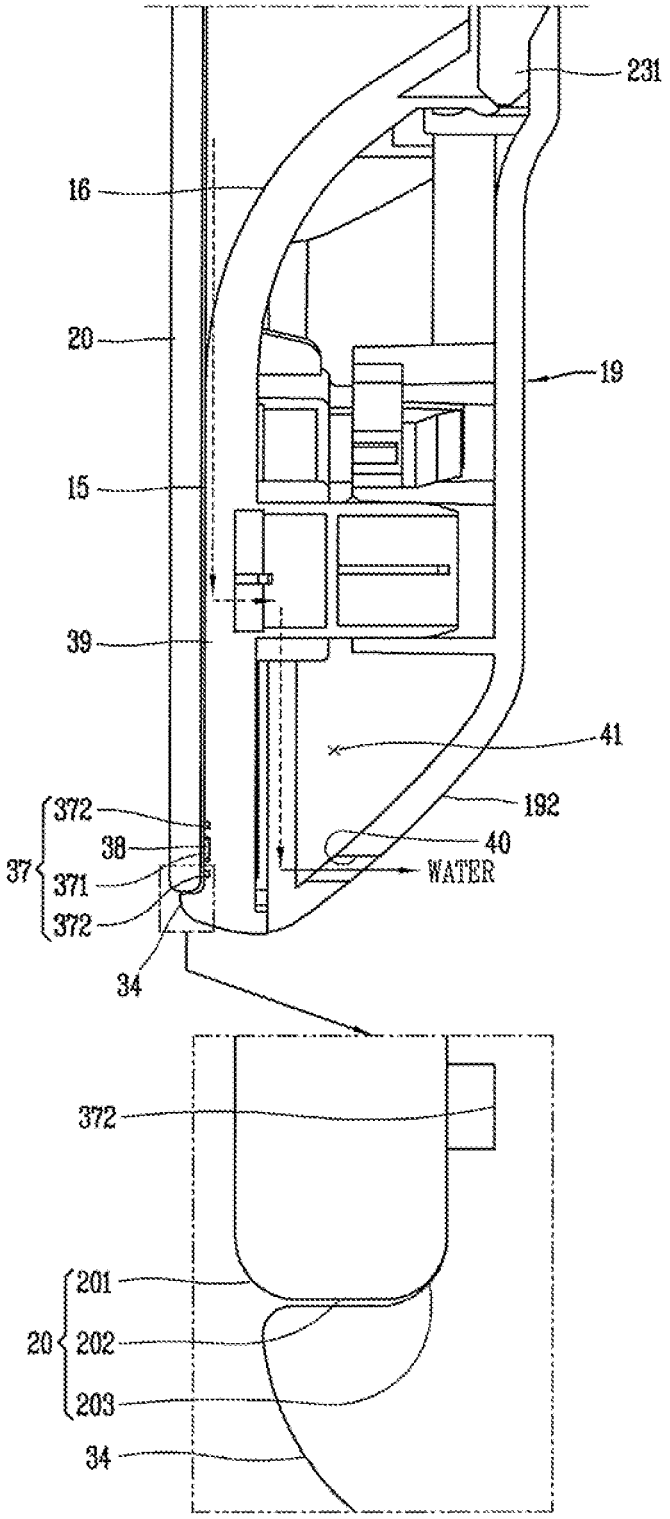
FIG. 14 is an enlarged view of portion "XIV" in FIG. 12.

FIG. 9 is a cross-sectional view, taken along line IX-IX in FIG. 8, illustrating a state in which moisture or water introduced into the front glass 20 flows into the outer frame 14 through the communication hole 39. FIG. 10 is a rear view illustrating a rear surface of the inner frame 19 in FIG. 3. FIG. 11 is a cross-sectional view, taken along line XI-XI in FIG. 10, illustrating a state in which moisture or water is discharged through the discharge hole 40. FIG. 12 is a cross-sectional view, taken along line XII-XII in FIG. 1, illustrating a state in which the door 12 is mounted to the front panel 101. FIG. 13 is a cross-sectional view, taken along line XIII-XIII in FIG. 2. FIG. 14 is an enlarged view of portion "XIV" in FIG. 12.

Referring to FIGS. 2, 3, 6, and 8 to 13, the door frame 13 may be provided with a flow path for providing communication between an interior of the door 12 and an exterior of the door 12. The interior of the door 12 may be understood as including a space provided between the front glass 20 and the outer frame 14. More specifically, the interior of the door 12 may be divided into a first space and a second space. The first space may be defined as a combination of the front glass 20, the outer frame 14, and the door window 23. The second space may be defined between the outer frame 14 and the inner frame 19.

The first space and the second space may be partitioned by the outer frame 14. The second space may be sealed by a separate sealing member. The sealing member may be selectively applied as necessary.

The sealing member may have a shape of a circular ring. The sealing member may be made of a rubber material, for example.

The sealing member may be installed between a rear end of the curved portion of the outer frame 14 and the outer edge portion 231 of the door window 23. The sealing member may maintain airtightness between the outer frame 14 and the door window 23.

The flow path may include communication hole 39, discharge hole 40, and annular space 41. The communication hole 39 may be formed in the outer frame 14. The communication hole 39 may be formed in a lower portion of the flat portion 15 of the outer frame 14. The communication hole 39 may be formed at a lower portion of the outer frame 14 based on a horizontal center line horizontally passing through a center of the outer frame 14 in the radial direction. The communication hole 39 may penetrate the flat portion 15 toward a rear plane of the inner frame 19. The circumference of the recess 103 may be understood as a portion where the recess 103 starts to be recessed.

Only one communication hole 39 may be provided or a plurality of communication holes 39 may be provided. In embodiments disclosed herein, it is shown that two communication holes 39 spaced apart from each other are located adjacent to a lower end of the outer frame 14.

A plurality of the communication holes 39 may be located on left and right or lateral sides of the flat portion 15 spaced apart from a perpendicular center line perpendicularly passing through a center of the flat portion 15 in the radial direction. Each of the plurality of communication holes 39 may be formed in various shapes, such as a rectangle, circle, or oval, for example. Each of the plurality of communication holes 39 may be formed in a rectangular shape having a narrow width and a long length. The communication hole 39 may extend in a left-right or lateral direction in the flat portion 15.

Each of the plurality of communication holes 39 may penetrate through the flat portion 15 in a thickness direction thereof. The communication hole 39 may be disposed between the opening 18 and the adhesive groove 37. The communication hole 39 may be located inside of the adhesive groove 37.

The plurality of communication holes 39 may be arranged side by side at a same height in the flat portion 15. The plurality of communication holes 39 may be spaced apart upwards from the adhesive groove 37.

The discharge hole 40 may be formed at one side of the rear surface of the door 12. The discharge hole 40 may be formed on the rear surface of the inner frame 19. The discharge hole 40 may be formed on a bottom end of the rear surface of the inner frame 19.

The inner frame 19 may define a portion of the rear side of the door 12. The discharge hole 40 may be exposed to the outside through the rear surface of the door 12. The discharge hole 40 may have a shape that is open toward a lower side of the door 12, or may have a shape that is open toward the rear side of the door 12, as illustrated.

The discharge hole 40 may be located at the lower side of the door 12 which is lower than a position of the communication hole 39. In this case, even if water penetrates into the door 12, the water may move from the communication hole 39 to the discharge hole 40 by gravity to be discharged outside of the door 12.

Only one discharge hole 40 may be provided or a plurality of discharge holes 40 may be provided. In embodiments disclosed herein, it is shown that one discharge hole 40 is located adjacent to the lower end of the inner frame 19. When the door frame 13 is viewed from the front, the door frame 13 is located lower than the two communication holes 39.

The discharge hole 40 may be formed in various shapes, such as a circle, rectangle, or oval, for example. In embodiments disclosed herein, the discharge hole 40 has a circular shape.

The discharge hole 40 may be formed in the curved portion 16 provided on the rear surface of the inner frame 19 or may be formed in the non-contact portion 192 inclined on the rear surface of the inner frame 19. In embodiments disclosed herein, the discharge hole 40 is formed in the non-contact portion 192 inclined on the lower portion on the rear surface of the inner frame 19.

The plurality of communication holes 39 may be disposed on a same plane. The discharge hole 40 may be disposed on a surface different from a surface on which the communication hole 39 is disposed. The discharge hole 40 may be formed in the non-contact portion 192 of the inner frame 19 intersecting the outer circumference of the outer frame 14. The non-contact portion 192 may be inclined at a predetermined angle toward the circumference of the recess 103.

Annular space 41 may be provided between the communication hole 39 and the discharge hole 40. The annular space 41 may be an internal flow path for providing communication between the communication hole 39 and the discharge hole 40. The annular space 41 may be provided in the second space. The annular space 41 may communicate with the first space, which is the interior of the door 12, through the communication hole 39, or may communicate with the outside of the door 12 through the discharge hole 40.

A moving path of moisture or water is as follows.

Moisture or water may penetrate into the first space inside of the door 12. In particular, the moisture having penetrated into the first space may move to the front glass 20 side. More specifically, the moisture may move into the gap between the front glass 20 and the flat portion 15.

Moisture may steam up or may cause condensate on an inner surface of the front glass 20 due to a temperature difference with the front glass 20. Moisture or water introduced into the gap may move to a lower portion of the gap due to gravity. Moisture or water in the lower portion of the gap may be introduced into the annular space 41 through the communication hole 39.

Moisture or water introduced into the annular space 41 may move down due to gravity. Moisture with a low specific gravity may move up then move down again toward the discharge hole 40 when the temperature drops.

Moisture or water may be discharged outside of the door 12 through the discharge hole 40. The discharge hole 40 may be spaced apart from the circumferential surface of the recess 103. Accordingly, moisture or water may freely evaporate or flow down through the discharge hole 40.

Therefore, according to embodiments disclosed herein, even if moisture penetrates into the door 12, the moisture may dry out through a flow path defined by the communication hole 39 and the discharge hole 40. Or, even if water penetrates into the door 12, the water may be discharged outside of the door 12 through the flow path defined by the communication hole 39 and the discharge hole 40. That is, the flow path may be understood as a ventilation flow path or a drain flow path in view of its function.

In addition, the non-transparent region 22 of the front glass 20 may cover the communication hole 39. That is, the communication hole 39 may be covered by the non-transparent region 22 and not exposed to the outside of the door 12. Accordingly, the appearance of the door 12 may be implemented neatly. Moreover, the discharge hole 40 may be positioned lower than the communication hole 39 so that moisture or water may move from the communication hole 39 to the discharge hole 40 due to gravity with no force.

Figure 15:
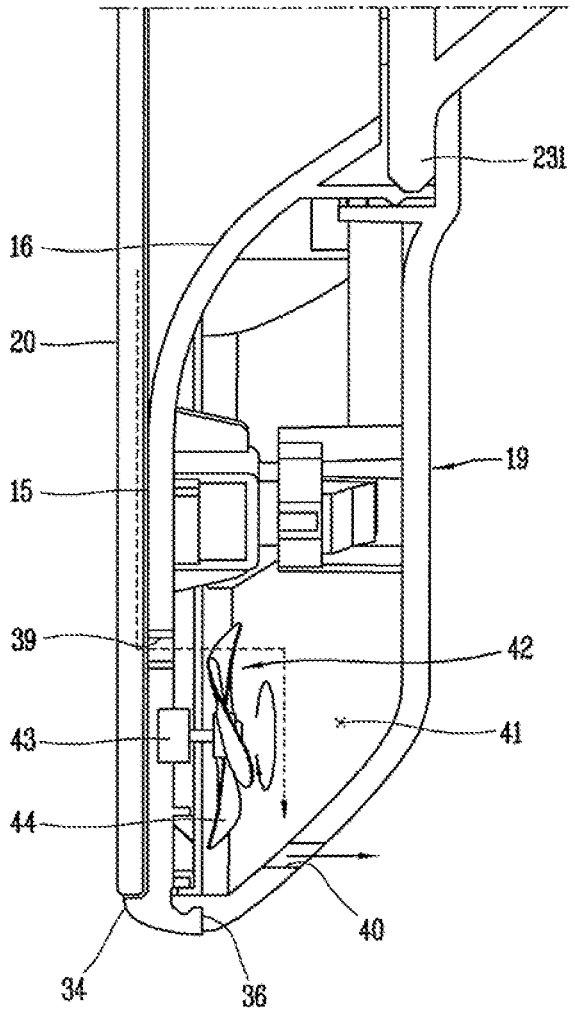
FIG. 15 is a schematic view illustrating a state in which a suction fan is mounted inside of the door frame in accordance with another embodiment.

FIG. 15 is a schematic view illustrating a state in which a suction fan 42 is mounted inside of the door frame 13 in accordance with another embodiment. In this embodiment, the suction fan 42 is further provided. Other components may be the same/like those of the previous embodiment, and thus, detailed description thereof has been omitted.

The suction fan 42 may suction moisture or water having penetrated into the first space. The suction fan 42 may be accommodated in the second space. The suction fan 42 may include a blade portion 44 having a plurality of blades and a drive unit that drives the blade portion 44.

The blade portion 44 may be rotatably disposed at a rear of the communication hole 39. The drive unit may be implemented by a fan motor 43. The fan motor 43 may be connected to the blade portion 44 through a shaft. The fan motor 43 may rotatably support the blade portion 44. The fan motor 43 may rotate the plurality of blades.

The suction fan 42 may supply a fluid with power to move the fluid. The suction fan 42 may rotate air at a rear of the communication hole 39. As the suction fan 42 rotates, the air in the second space at the rear side of the communication hole 39 has a flow rate which increases and a pressure which decreases in comparison to the air inside of the door 12. The air inside of the door 12 is moved from the first space to the second space by the suction fan 42. Also, moisture or water is suctioned into the second space through the communication hole 39.

Moisture having penetrated into the first space may be supplied with power by the suction fan 42 and suctioned through the communication hole 39. Water in the first space may be suctioned into the communication hole 39 by the power of the suction fan 42.

According to embodiments disclosed herein, even if moisture penetrates inside of the door 12, the moisture dries easily by quickly moving to the communication hole 39 and the discharge hole 40 by the suction fan 42. Also, the front glass 20 may quickly remove a phenomenon of being cloudy due to steaming up, for example. In addition, even if water penetrates inside of the door 12, a flow rate of the water may be accelerated by the suction fan 42 to induce water to drain through the communication hole 39 and the discharge hole 40, so that the water may be smoothly discharged outside of the door 12.

Embodiments disclosed herein solve problems of the related art. Embodiments disclosed herein provide a laundry treating apparatus having a structure in which moisture or water having penetrated into a door may be removed. Embodiments disclosed herein further provide a laundry treating apparatus in which a structure for removing moisture or water is not visible from outside of a door.

Further, embodiments disclosed herein provide a laundry treating apparatus capable of discharging moisture or water having penetrated inside of a door to outside with no force. Furthermore, embodiments disclosed herein provide a laundry treating apparatus capable of minimizing a weakening of an adhesive force between a front glass and a door frame by moisture or water having penetrated to a front glass side of a door. Also, embodiments disclosed herein provide a laundry treating apparatus capable of forcibly discharging moisture or water having penetrated inside of a door to outside using power.

According to embodiments disclosed herein, a flow path may be provided inside of a door frame to communicate an inside and an outside of a door. A vent flow path for discharging steam or a drain flow path for discharging residual water may be provided, thereby preventing moisture or water having penetrated into the door from remaining inside of the door.

A non-transparent region may be provided in a front glass. The non-transparent region may cover a communication hole providing communication between an inside and an outside of a door, thereby preventing the communication hole from being exposed to the outside of the door.

A communication hole may be formed at a lower portion of a front surface of a door frame, and a discharge hole may be formed at a lower portion of a rear surface of the door frame to communicate with the communication hole. The discharge hole may be located lower than the communication hole. Thus, water remaining inside of a door may be discharged out through the communication hole and the discharge hole by gravity, without additional power.

A communication hole may be disposed between an opening of a door frame and an adhesive groove, and thus, moisture or water having penetrated through the opening may be discharged out through the communication hole before moving to an adhesive groove. This may result in minimizing a weakening of an adhesive force due to such moisture or water.

A suction fan may be provided between an outer frame and an inner frame. Moisture or water having penetrated inside of a door may be forcibly discharged by the suction fan.

A laundry treating apparatus according to embodiments disclosed herein may include a main body and a door. The main body may be provided with a laundry inlet port on a front surface thereof. The door may open and close the laundry inlet port.

The door may include an outer frame, a front glass, a door window, and a flow path. The outer frame may be disposed toward or face an outside of the main body.

The front glass may be attached to a front surface of the outer frame. The front glass may define a front surface of the door.

The door window may be spaced from the front glass toward the laundry inlet port. The door window may be disposed with respect to the laundry inlet port.

The inner frame may be connected to the outer frame and the door window. The inner frame may define a portion of a rear side of the door.

A flow path may communicate an interior of the door with an exterior of the door. The interior of the door may be defined between the front glass and the outer frame. The flow path may discharge moisture or water having penetrated into the door to the outside of the door.

The outer frame may include a communication hole and a discharge hole. The communication hole may be formed in the outer frame. The discharge hole may be formed in the inner frame. The communication hole may communicate with the interior of the door. The discharge hole may communicate with the exterior of the door.

The outer frame may be defined in (or may have) a ring shape. The communication hole may be formed at a lower portion of the outer frame based on a horizontal center line horizontally passing through a center of the outer frame in a radial direction. Moisture or water having penetrated into the door may move to the communication hole by gravity.

The discharge hole may be located lower than the communication hole. Water or moisture may be transferred from the communication hole to the discharge hole without providing additional power.

The outer frame may include a mounting guide, a flat portion, an opening, and an adhesive groove. The mounting guide may surround an outer surface of the front glass. A flat portion may extend at an inner side of the mounting guide in a radial direction.

The opening may be provided at an inner side of the flat portion to correspond to the laundry inlet port. The adhesive groove may be defined in a ring shape on the flat portion extending from the mounting guide to the opening.

The outer frame may further include a curved portion. The curved portion may be disposed between the flat portion and the opening. The curved portion may be defined in a curved shape from the flat portion toward an outer edge portion of the door window.

An annular space may be formed between the communication hole and the discharge hole. The annular space may communicate the communication hole with the discharge hole. The annular space may be provided between the outer frame and the inner frame.

The flat portion may be extended from the adhesive groove to the opening. The communication hole may be formed in the flat portion. The communication hole may be formed at lateral sides of the flat portion and spaced apart from a perpendicular center line.

The communication hole may be located higher than a lower end of the adhesive groove. Water or moisture may reach the communication hole first before moving from the opening to the adhesive groove, and water or moisture may be discharged outside of the door through the communication hole.

The front glass may include a non-transparent region and a transparent region. The non-transparent region may be disposed to cover the adhesive groove and the communication hole. The transparent region may be disposed inside of the non-transparent region.

The main body may include a front panel and a recess. The laundry inlet port may be provided on the front panel.

The recess may surround the laundry inlet port and be recessed in the front panel. The recess may accommodate a portion of the inner frame. The laundry inlet port may be eccentrically positioned upwardly from a center of the recess.

Each of the outer frame and the inner frame may be defined in a ring shape. Each opening may be provided on the inner side of the ring to correspond to the laundry inlet port. The opening may be eccentrically formed upwardly from a center of each of the outer frame and the inner frame.

The adhesive groove for attaching the front glass may be formed in the outer frame in a ring shape. A distance between the adhesive groove and the opening may increase from an upper portion to a lower portion of the outer frame. The communication hole may be formed in a region with a longest distance. A space for forming the communication hole inside of the door may be secured easily.

The front glass may include a transparent region and a non-transparent region. The transparent region may be provided with respect to the opening and the door window. The non-transparent region may surround the transparent region. The non-transparent region may cover the communication hole.

The discharge hole may be spaced apart from a circumference of the recess. Water or moisture may be easily discharged through the discharge hole.

Front and rear surfaces of the front glass may be flat plates. The front glass may be defined in a shape of a circular plate. The discharge hole may be disposed at an outer side of the recess. Diameters of the outer frame and the inner frame may be greater than the outer diameter of the recess.

The discharge hole may penetrate from the inner frame toward a circumferential portion where the recess starts to be recessed. Even if a position and a size of a drum are fixed, the door may be increased in size.

The door may further include a suction fan. The suction fan may be installed between the outer frame and the inner frame. The suction fan may suction moisture and water having penetrated into the door through the communication hole and discharge the water and moisture through the discharge hole.

The suction fan may include a blade portion and a fan motor. The blade portion may be disposed between the communication hole and the discharge hole. The fan motor may be configured to rotate the blade portion.

As the flow path is formed in the door frame to provide communication between an inside of the door and an outside of the door, even if moisture or water is introduced into the front glass side, moisture may be removed or water may be discharged through the flow path, thereby preventing moisture or water from remaining inside of the door. The non-transparent region of the front glass may cover the communication hole formed in the outer frame, so that the communication hole is not visible to the naked eye from outside of the door. Accordingly, an appearance of the door may be improved and implemented neatly.

The discharge hole may be positioned lower than the communication hole so that moisture or water may be moved from the communication hole to the discharge hole by gravity with no force. Also, as the suction fan is disposed between the communication hole and the discharge hole, even if moisture penetrates inside of the door, the penetrated moisture may be quickly suctioned into the communication hole and the discharge hole by the suction fan. Therefore, moisture may easily dry. Also, the front glass may quickly remove a phenomenon of being cloudy due to steaming up, for example. Moreover, even if water penetrates inside of the door, a flow rate of the water may be accelerated by the suction fan to induce water to drain through the communication hole and the discharge hole, so that the water may be smoothly discharged outside of the door.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a main body having a laundry inlet port on a front surface thereof; and a door configured to open and close the laundry inlet port, wherein the door comprises:

an outer frame facing an outside of the main body;

a front glass attached to a front surface of the outer frame to define a front surface of the door;

a door window spaced apart from the front glass toward the laundry inlet port and disposed to correspond to the laundry inlet port;

an inner frame connected to the outer frame and the door window, and defining a portion of a rear surface of the door; and a flow path to allow drainage of liquid from inside the door to outside of the door, wherein the flow path comprises:

at least one communication hole formed through the outer frame to face an inner surface of the front glass in the outer frame, and wherein the at least one communication hole is arranged adjacent to the front glass.

2. The apparatus of claim 1, wherein the flow path is provided between the front glass and the outer frame.

3. The apparatus of claim 1, wherein the flow path further comprises:

a discharge hole provided in the inner frame.

4. The apparatus of claim 3, wherein the flow path further comprises:

an inner space defined between the front glass and the outer frame by which the at least one communication hole communicates with the discharge hole.

5. The apparatus of claim 1, wherein the outer frame has a ring shape, and wherein the at least one communication hole is formed at a lower portion of the outer frame based on a horizontal center line horizontally passing through a center of the outer frame in a radial direction.

6. The apparatus of claim 3, wherein the discharge hole is positioned lower than the at least one communication hole.

7. The apparatus of claim 3, wherein the outer frame comprises:

a mounting guide that surrounds an outer surface of the front glass;

a flat portion that extends from an inner side of the mounting guide in a radial direction;

an opening formed at an inner side of the flat portion to correspond to the laundry inlet port; and an adhesive groove formed in a ring shape in the flat portion and configured to receive an adhesive to couple the front glass to the outer frame.

8. The apparatus of claim 7, wherein the outer frame further comprises:

a curved portion disposed between the flat portion and the opening, and extending in a curved shape from the flat portion toward an outer edge portion of the door window.

9. The apparatus of claim 8, wherein an annular space that communicates with the at least one communication hole and the discharge hole is provided between the outer frame and the inner frame.

10. The apparatus of claim 7, wherein the at least one communication hole is provided in the flat portion between the adhesive groove and the opening.

11. The apparatus of claim 7, wherein the at least one communication hole comprises a plurality of communication holes located at lateral sides of the flat portion in a spaced manner, with respect to a perpendicular center line perpendicularly passing through a center of the outer frame in a radial direction, and wherein the plurality of communication holes is located above the adhesive groove.

12. The apparatus of claim 7, wherein the front glass comprises:

a non-transparent region that covers the adhesive groove and the at least one communication hole;

a transparent region disposed at an inner side of the non-transparent region.

13. The apparatus of claim 3, wherein the main body comprises:

a front panel having the laundry inlet port; and a recess recessed in the front panel to surround the laundry inlet port, and accommodating a portion of the inner frame.

14. The apparatus of claim 13, wherein the laundry inlet port is upwardly eccentric from a center of the recess.

15. The apparatus of claim 14, wherein each of the outer frame and the inner frame has a ring shape having an opening corresponding to the laundry inlet port, and wherein the opening is formed to be upwardly eccentric from a center of each of the outer frame and the inner frame.

16. The apparatus of claim 15, wherein an adhesive groove is formed in a ring shape in the outer frame to receive an adhesive to attach the front glass to the outer frame, wherein a distance between the adhesive groove and the opening increases from an upper portion to a lower portion of the outer frame, and wherein the at least one communication hole is provided in a region in which the distance is longest.

17. The apparatus of claim 15, wherein the front glass comprises:

a transparent region provided to correspond to the opening and the door window; and a non-transparent region that surrounds the transparent region and covers the at least one communication hole.

18. The apparatus of claim 13, wherein the discharge hole is spaced apart from a circumference of the recess.

19. The apparatus of claim 13, wherein the front glass has flat front and rear surfaces and has a shape of a circular plate.

20. The apparatus of claim 13, wherein the discharge hole is disposed adjacent to an outer side of the recess when the door is in a closed position.

21. The apparatus of claim 13, wherein the outer frame and the inner frame have diameters greater than an outer diameter of the recess, and wherein the discharge hole is formed through the inner frame toward a circumferential portion where the recess starts to be recessed.

22. A laundry treating apparatus comprising:

a main body having a laundry inlet port on a front surface thereof; and a door configured to open and close the laundry inlet port, wherein the door comprises:

an outer frame facing an outside of the main body;

a front glass attached to a front surface of the outer frame to define a front surface of the door;

a door window spaced apart from the front glass toward the laundry inlet port and disposed to correspond to the laundry inlet port;

an inner frame connected to the outer frame and the door window, and defining a portion of a rear surface of the door;

a flow path to allow drainage of liquid from inside the door to outside of the door, wherein the flow path comprises:

at least one communication hole provided in the outer frame; and a discharge hole provided in the inner frame; and a suction fan provided between the outer frame and the inner frame, to allow liquid that penetrates the door to be suctioned through the at least one communication hole and discharged through the discharge hole, wherein the suction fan comprises:

a plurality of blades disposed between the at least one communication hole and the discharge hole; and a fan motor to drive the plurality of blades.

23. A laundry treating apparatus, comprising:

a main body having a laundry inlet port on a front surface thereof; and a door configured to open and close the laundry inlet port, wherein the door comprises:

an outer frame facing an outside of the main body;

a front glass attached to a front surface of the outer frame to define a front surface of the door;

a door window spaced apart from the front glass toward the laundry inlet port and disposed to correspond to the laundry inlet port;

an inner frame connected to the outer frame and the door window, and defining a portion of a rear surface of the door; and a flow path to allow drainage of liquid from inside the door to outside of the door, wherein the flow path comprises:

at least one communication hole provided in the outer frame;

a discharge hole provided in the inner frame; and an inner space defined between the front glass and the outer frame by which the at least one communication hole communicates with the discharge hole, wherein liquid flows from the at least one communication hole, through the inner space to the discharge hole where the liquid is discharged outside of the door, wherein the at least one communication hole is formed through the outer frame to face an inner surface of the front glass in the outer frame, and wherein the at least one communication hole is arranged adjacent to the front glass.

24. The apparatus of claim 23, wherein the outer frame has a ring shape, and wherein the at least one communication hole is formed at a lower portion of the outer frame based on a horizontal center line horizontally passing through a center of the outer frame in a radial direction.

25. The apparatus of claim 23, wherein the discharge hole is positioned lower than the at least one communication hole.

26. The apparatus of claim 23, wherein the outer frame comprises:

an adhesive groove formed in a ring shape and configured to receive an adhesive to couple the front glass to the outer frame, and wherein the at least one communication hole is disposed above the adhesive groove.

27. A laundry treating apparatus comprising:

a main body having a laundry inlet port on a front surface thereof; and a door configured to open and close the laundry inlet port, wherein the door comprises:

an outer frame facing an outside of the main body;

a front glass attached to a front surface of the outer frame to define a front surface of the door;

a door window spaced apart from the front glass toward the laundry inlet port and disposed to correspond to the laundry inlet port;

an inner frame connected to the outer frame and the door window, and defining a portion of a rear surface of the door;

a flow path to allow drainage of liquid from inside the door to outside of the door, wherein the flow path comprises:

at least one communication hole provided in the outer frame;

a discharge hole provided in the inner frame; and an inner space defined between the front glass and the outer frame by which the at least one communication hole communicates with the discharge hole, wherein liquid flows from the at least one communication hole, through the inner space to the discharge hole where the liquid is discharged outside of the door; and a suction fan provided between the outer frame and the inner frame, to allow liquid that penetrates the door to be suctioned through the at least one communication hole and discharged through the discharge hole.

28. A laundry treating apparatus, comprising:

a main body having a laundry inlet port on a front surface thereof; and a door configured to open and close the laundry inlet port, wherein the door comprises:

an outer frame facing an outside of the main body;

a front glass attached to a front surface of the outer frame to define a front surface of the door;

a door window spaced apart from the front glass toward the laundry inlet port and disposed to correspond to the laundry inlet port;

an inner frame connected to the outer frame and the door window, and defining a portion of a rear surface of the door;

a flow path to allow drainage of liquid from inside the door to outside of the door, wherein the flow path comprises:

at least one communication hole provided in the outer frame;

a discharge hole provided in the inner frame; and a suction fan provided between the outer frame and the inner frame, to allow liquid that penetrates the door to be suctioned through the at least one communication hole and discharged through the discharge hole.

29. The apparatus of claim 28, wherein the flow path further comprises:

an inner space defined between the front glass and the outer frame by which the at least one communication hole communicates with the discharge hole.

30. The apparatus of claim 28, wherein the outer frame comprises:

an adhesive groove formed in a ring shape and configured to receive an adhesive to coupled the front glass to the outer frame, and wherein the at least one communication hole is disposed above the adhesive groove.

* * * * *